US005090172A

United States Patent [19]

Chana et al.

[11] Patent Number: 5,090,172

[45] Date of Patent: Feb. 25, 1992

[54] SHEARHEAD REINFORCEMENT

[75] Inventors: Palvinder Chana, Langley; John D. Clapson, Allbrook, both of England

[73] Assignee: Square Grip Limited, United Kingdom

[21] Appl. No.: 602,102

[22] Filed: Oct. 22, 1990

[51] Int. Cl.[5] ..... E04B 1/16

[52] U.S. Cl. ..... 52/252; 52/253

[58] Field of Search ..... 52/250, 251, 252, 253

[56] References Cited

U.S. PATENT DOCUMENTS

| | | | |
|---|---|---|---|
| 926,497 | 6/1909 | Kahn | 52/253 |
| 1,335,780 | 4/1920 | Barton | 52/253 |
| 3,435,572 | 4/1969 | Fuchs | 52/251 |
| 4,333,285 | 6/1982 | Koizumi et al. | 52/252 |

*Primary Examiner*—Richard E. Chilcot, Jr.
*Assistant Examiner*—Wynn E. Wood
*Attorney, Agent, or Firm*—Allegretti & Witcoff, Ltd.

[57] ABSTRACT

A shearhead for reinforcing junctions between for example vertical columns and horizontal floors where at least the floor is formed in reinforced concrete. The shearhead is in the form of a hoop bar for extending around a column with a plurality of shear legs depending therefrom. Each shear leg includes a portion extending above the hoop bar, which portion forms a hook for coupling to reinforcement in the slab of concrete extending laterally from the column.

12 Claims, 7 Drawing Sheets

60
62
62
62
64
66
64
58
70

SHEARHEAD REINFORCEMENT

BACKGROUND TO THE INVENTION

This invention relates to the design of shearheads in the reinforcement of junctions between for example, vertical columns and horizontal floors, where at least the floor is formed in reinforced concrete A shearhead is a separately definable structure embodied in the concrete at the junction which serves to spread the load of the floor on the respective column and thereby reduce the effect of the vertical forces; i.e., reduce the stress in the slab concrete by increasing the critical shear perimeter around the column.

It has long been recognised that supporting an horizontally extending body or slab on one or more vertical columns imposes bending and shear forces on the slab at the junctions with the columns which must be withstood by the structure of the slab or resisted by specific design features at the respective junction. Traditionally, the cross-section of the columns has been enlarged at least at the junction either wholly or locally at the junction by the introduction of flared column heads. Alternatively or additionally, the depth of the slab has been increased in the vicinity of the column to reduce the stresses arising particularly from the local shear forces. However, in modern building design it has become desirable to eliminate such obstructions or modifications to the slab, and provide clear substantially perpendicular junctions between each column and the lower uniform surface of the slab. It is also desirable to be able to use columns of smaller cross-section for a given slab loading or to increase the span of the slab for a given column size or cross-section. A number of shearhead designs have been proposed to these ends, and examples of such proposals are disclosed in European Patent Specification Nos. 0079413 and 0128994. This subject has also been considered in the following papers published by the American Concrete Institute:

1. Corley, W. G., and Hawkins, N. M., "Shearhead Reinforcement for Slabs," ACI Journal, Proceedings V.65, No. 10, October 1968, pp. 811-824.
2. Hawkins, N. M., and Corley, W. G., "Moment Transfer to Columns in Slabs with Shearhead Reinforcement", *Shear in Reinforced Concrete,* Special publication Sp-42, American Concrete Institute, Detroit, 1974, pp. 847-879. Also, Research and Development Bulletin RD 037.01D, Portland Cement Association.

SUMMARY OF THE INVENTION

Research into shearhead design is based essentially on the premise that shear failure of the laterally extending slab occurs along a shear failure plane on a perimeter, around the head of the respective column. If this shear perimeter can be enlarged; i.e., spaced from the column axis, then the shear forces acting on the slab at a particular point on the perimeter will be reduced.

Research into the above problem has followed two distinct paths. In the first, shearheads have been designed as reinforcing structures which are placed directly on a column and extend laterally outward therefrom to define a shear perimeter significantly spaced from the column axis. In the second, elements are introduced into the slab to provide more local shear reinforcement, effectively to a radius from the column at which the slab can be sufficiently self-supporting Such local reinforcement can be interconnected to form a linked unit. The present invention is directed at the second of these options.

The present invention provides a shearhead for casting within the body of a laterally extending slab to reinforce a junction between the slab around a supporting column. The shearhead comprises a hoop bar for extending around the column with a plurality of shear legs attached thereto and depending therefrom. Each shear leg includes a portion extending above the hoop bar, which portion forms a hook for coupling to slab reinforcement. The hoop bar will normally extend substantially in one plane; e.g., in a horizontal plane around the column. The cross-section of the column is not critical, but will normally be circular, square or rectangular.

The hoop bar in shearheads according to the invention may be divided into discrete sections which can be installed separately in the shearhead assembly. Each section embodying this aspect of the invention comprises an upper bar from which a plurality of shear legs depend, if desired to a lower bar to form a readily handleable unit. Such a unit can be suitably supported in the shearhead assemby at the desired location or locations prior to casting the concrete slab thereover. However, a substantially continuous hoop bar, or interconnected such sections, is preferred as the effective encircling of the column by substantially continuous length of bar can structurally strengthen the function against shear forces. The reason for this is that in the region of concrete confined within the bar, cracking of the concrete is inhibited.

In preferred embodiments of the invention, the distal end of each hook extends substantially horizontally when installed on a column. This facilitates the coupling to reinforcement in the slab, as the reinforcement can be readily slid under the hooks, or vice versa. If the shear legs are to be coupled to only one set of reinforcement rods in the slab, then all the distal ends of the hooks can be made parallel. If the shear legs are to be coupled to reinforcement rods extending in different directions, then the orientation of the hooks can be similarly varied. Typically, different sets of hooks are oriented to extend in different, normally orthogonal directions. As the reinforcement in the slab will normally comprise rods extending in one direction at one level and in another direction at another level, then again the height of one set of hooks relative to the hoop bar can be different from that of another.

Shearheads according to the invention may be embodied in circular form. However, as the principal forces acting in a shearhead assembly can be resolved along perpendicular axes, preferred embodiments of the invention are in substantially square or rectangular form. This also facilitates the division of the hoop bar into sections and/or the hooks of the shear legs into sets as described above for coupling to perpendicularly oriented reinforcement rods in the slab. It should be noted though, that the attachment of the shearhead to reinforcement in the slab is not essential. Preferably though, it extends above the reinforcement to prevent the creation of a shear failure plane below the reinforcement. Such attachment does of course, additionally provide a convenient means by which the shearhead can be located prior to the slab being cast.

Shearheads according to the invention can include an additional bar to which the shear legs are attached at their lower ends. This is though, not essential, but provides a convenient means by which the shearhead and the orientation of the shear legs thereof may be set. A light steel mesh suitably disposed relative to the upper hoop bar and the shear legs can be equally effective. Such a lower hoop bar or mesh can also provide an alternative means by which the shearhead is located in the slab; i.e., on shuttering against which the slab is cast. It can be supported on separate spacers, or props attached to the lower hoop bar or mesh, or on props attached directly to at least some of the shear legs. This last option is of course available when a lower hoop bar or mesh is not used.

The shear legs of shearheads according to the invention may take a number of different forms. Most simply, each shear leg comprises a single length of rod shaped to form the hook at its upper end. The hook forms an upper anchorage point in the subsequently cast slab, and a lower anchorage point is normally also formed; for example by shaping its lower end into a second hook which can extend around a lower slab reinforcement rod. Preferred shear legs however, each comprise a single length of rod which extends to form a loop below the hoop bar with both ends extending above the hoop bar to a hook. The loop thus forms a lower anchorage point in the cast slab. The shape of the loop may vary, but a preferred shape is broadly U-shaped, with two leg sections downwards from each hook to a link section thereby minimising bearing stresses In another form, the shape of the loop may be broadly triangular, with two leg sections converging downwardly to a single bend. Each leg is attached to the hoop bar adjacent each hook. In some embodiments each shear leg is in the form of a closed or substantially closed curve through which the slab reinforcement passes where the coupling is made. The preferred shape in these embodiments is square or rectangular, although other shapes can be used, with particular benefit in certain applications.

For some applications, the shear legs will depend vertically from the upper hoop bar. However, different applications may require different orientations of the legs. For example they might depend downwardly and outwardly from the hoop bar, relative to the column. The depth to which the shear legs extend from the upper bar will also affect the reinforcement they provide. Generally, the shear legs should extend as far as possible towards the lower surface of the slab, i.e., to but not into the cover layer. Generally, this means to or to just below the level of the lower layer of reinforcement in the slab and the legs may be attached to such lower reinforcement, for example by extending around rods thereof. However, we have found that an equivalent effect can be acheived if the shear legs merely extend to this level between lengths of the lower reinforcement without such attachment. This is of particular benefit as shearheads or hoop bar sections thereof according to the invention can be dropped or lowered into place after all the lower slab reinforcement has been put in place. Thus, a shearhead of the invention can be lowered into place by allowing the depending sections to pass through openings in the slab reinforcement. This is particularly advantageous When the lower slab reinforcement comprises welded mesh reinforcement, and not separate reinforcement bars. It is preferred in all embodiments of the invention Where the slab has upper and lower layers of reinforcement that the shear legs extend fully between the layers to prevent the creation of shear failure planes in this region.

A shearhead assembly embodying the invention will have the shearhead and slab reinforcement suitably supported on shuttering prior to the concrete slab being cast. Further, in some embodiments two or more shearheads extending around the same column may be employed, the second being disposed outside the first, but surrounding it generally in the same plane. Concentric square, rectangular or circular shearheads according to the invention may be used in this way.

Shearheads according to the invention can be used on columns of any suitable construction. Typically, suitable columns are of reinforced concrete or steel. Shearheads of the invention can also be used in conjunction with shearheads of other types. As the shearheads of this invention extend around or spaced from the column axis, they are particularly suited as auxiliaries to other types of shearheads disposed on or around the column axis. In this connection reference is directed to our co-pending Application filed today under our Agent's reference EH 34198. It will be appreciated that shearheads of this invention may interdigitate with laterally extending beams or arms of such other shearhead types to more closely define the shear perimeter thereof.

The above discussion is concerned primarily with shearheads disposed within a horizontal area of cast concrete, in which the hoop bar extends around the column in a generally symmetrical fashion. Shearhead structures broadly of the kind disclosed herein can also be useful at the periphery of such an area; in other words with at least one boundary of the shearhead coinciding with the column at the periphery of the area. Thus, a shearhead structure comprising a hoop bar with a plurality of shear legs attached thereto and depending therefrom can be cast within the body of a laterally extending slab at the periphery of the area thereof with a part of the hoop bar at the perimeter of the shearhead being cast within a supporting column also disposed at the periphery of the area. This can most conveniently be accomplished where the shearhead is of square or rectangular planar shape such that a straight edge thereof can be laid against the periphery of the area to be cast. Two or more such shearheads can be used adjacent each other if desired, and if the point on the periphery of the area to be cast is at a corner with an angle of greater than 180°, a plurality of shearheads can be disposed around the corner. Shearheads used in these variants will normally comprise at least two and normally a greater plurality of concentric hoop bars with depending shear legs.

We have also found that shearheads of the kind described above in which the hoop bar does not wholly surround the column can provide effective reinforcement of the junction. Thus, a shearhead embodying the invention can comprise for example a hoop bar extending around three sides of a column between two points on the periphery of the area to be cast, with shear legs depending therefrom. In this variant, an upper and a lower hoop bar are preferably used, which bars are linked by vertical section at the periphery of the area to be cast. This arrangement can result in the creation of a torsion box in the region of the junction, which extends horizontally on either side of the column to limits defined by the hoop bars. If a plurality of concentric hoop bars are used, as is preferred, then the horizontal length of this torsion box can be considerable, and provide effective reinforcement into the body of the slab.

The invention will now be described by way of example, and with reference to the accompanying schematic drawings:

DESCRIPTION OF PREFERRED EMBODIMENTS

Figure 1:
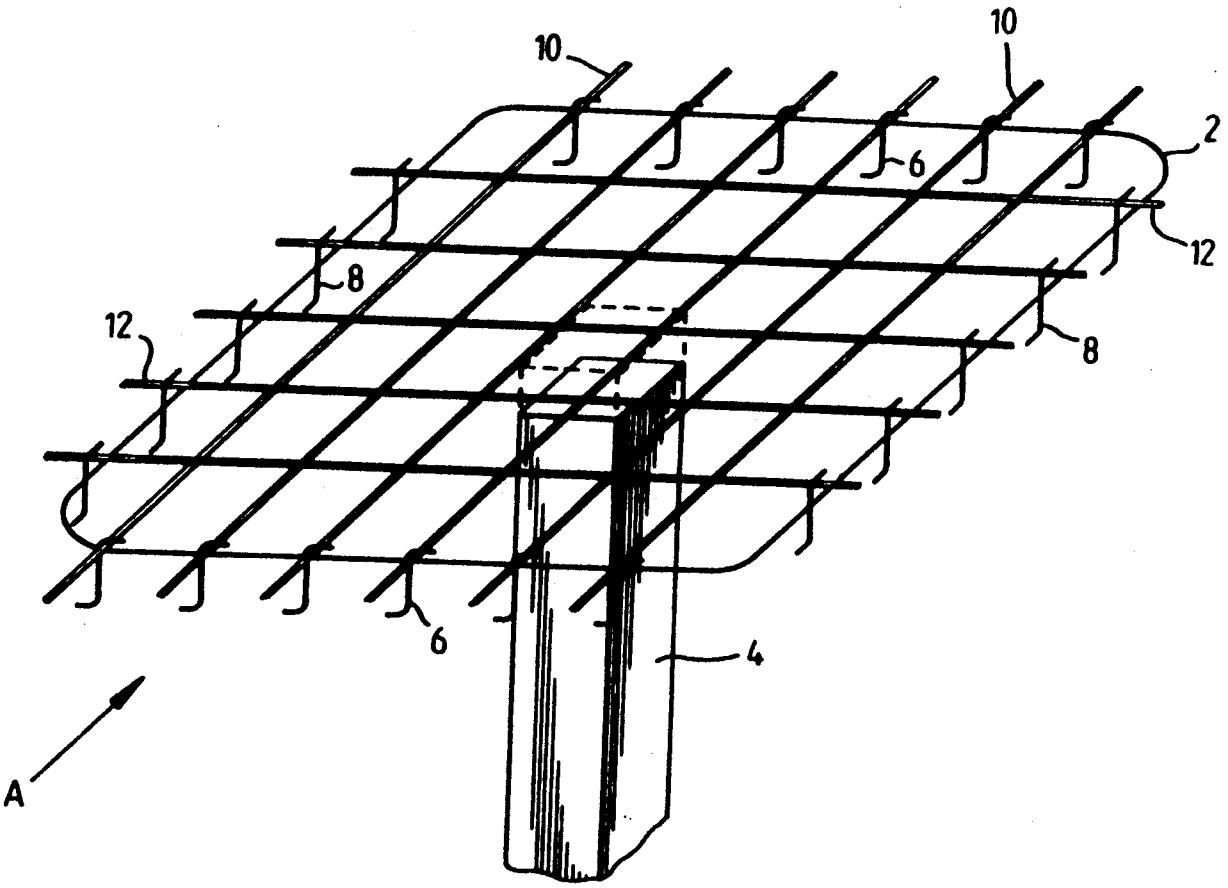
FIG. 1 is a perspective view showing the installation of a shearhead according to a first embodiment of the invention at the top of a column.

The shearhead shown in FIG. 1 comprises a single hoop bar 2 disposed over the top of a column 4, and surrounding the axis thereof. The hoop bar 2 is of generally square form with its respective sides aligned parallel to the sides of the column 4 which is also of square cross-section. Attached to the hoop bar 2 is a plurality of shear legs 6, 8 as indicated on the respective sides of the hoop bar. In casting a substantially horizontal reinforced concrete slab (not shown) at the top of the vertical column 4, shuttering, or a temporary structure, usually of wood, used to hold concrete, during setting, (also not shown) is appropriately located at the top of the column 4, and reinforcement rods 10,12 are suitably supported thereon. The rods 10 are laid first, with the rods 12 laid thereover either supported by the rode 10 or by some other suitable structure constructed and arranged to support the rods 12. Each shear leg 6, 8 has a hook at the top thereof which is disposed above the hoop bar 2, and at least some of these hooks are used to suspend the hoop bar 2 and all the shear legs 6, 8 from the reinforcing rods 10, 12. In order to properly orientate the shearhead substantially horizontally, the hooks on the shear legs 6 are disposed closer to the hoop bar 2 and those on the shear legs 8. In this way, the hooks on the shear legs 6 may be attached to the rods 10, and the hooks on the shear legs 8 to the rods 12, while retaining the hoop bar 2 substantially horizontal.

Figure 2:
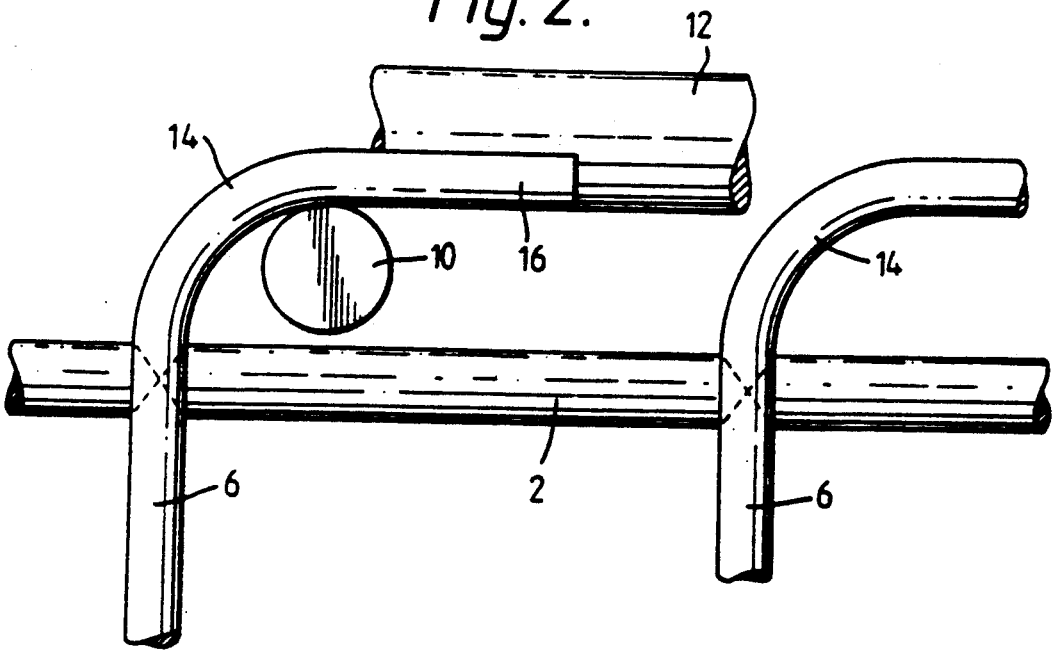
FIG. 2 is a detail view indicated by arrow A in FIG. 1 showing a part of the shearhead and the slab reinforcement.

The coupling of the shear legs to the reinforcing rods 10 and 12 in FIG. 1 is shown more clearly in FIG. 2. Each leg 6 is attached to the hoop bar 2, typically by a spot weld, and a portion of each leg extends above the bar 2 to form a hook 14. The distal end 16 of the hook 14 extends substantially horizontally and parallel to the plane of the hoop bar 2. This enables the hook 14 to be readily slid over the reinforcing rod 10 or alternatively, if the shearhead is located before the slab reinforcement, enables the rod 10 to be readily slid under the hook 14.

As shown in FIG. 2, the transverse reinforcing rod 12 is supported directly on the rods 10, but not in the vicinity of the hook 14. To enable the shearhead to be to be coupled to the rods 12 as well as to the rods 10, the shear legs 8 are formed in a similar shape to the shear legs 6, but with the respective hook 14 and distal end 16 further spaced from the hoop bar 2. The distal end 16 would again extend substantially parallel to the adjacent length of hoop bar 2, but of course perpendicular to the ends of the shear legs 6 as the respective legs 8 will be attached to a perpendicular section of hoop bar 2.

Figure 3:
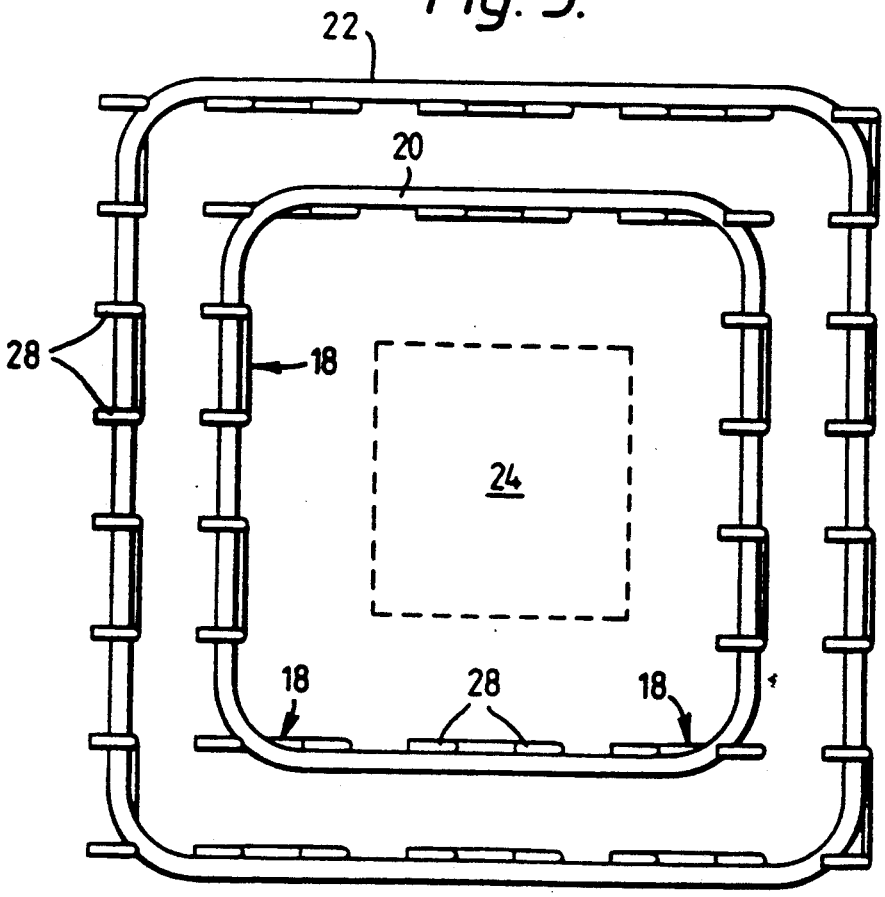
FIG. 3 is a plan view of a second embodiment of the invention in which two shearheads are disposed around a column.
Figure 4:
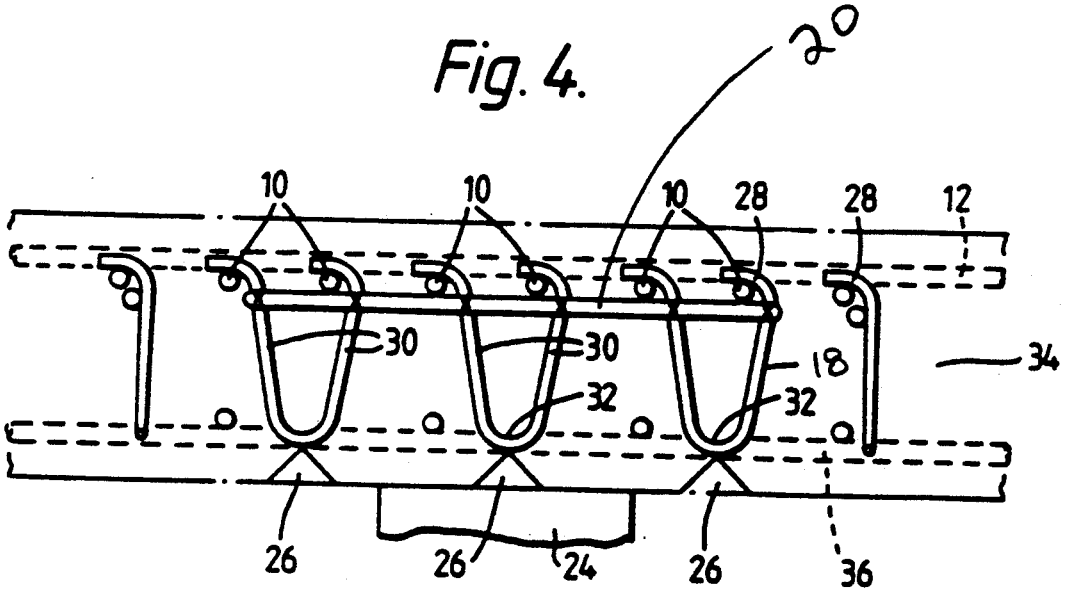
FIG. 4 is an enlarged front elevation of part of the two shearheads shown in FIG. 3.

The above described arrangement and orientation of shear legs 6, 8 on the hoop bar 2 can of course be varied to suit the structure within the concrete slab upon which the shearhoop is to be suspended. Particularly, it should be noted that the orientation of the hooks 14 can of course be preserved even if the hoop bar is of different; e.g., circular form. However, a square or rectangular form is preferred, as is a perpendicular orientation of respective shear legs as this simplifies the attachment of the hooks to slab reinforcement, which is normally arranged in two perpendicular directions along which the internal forces in the structure can be readily resolved FIG. 3 and 4 show an alternative shearhead construction in which shear legs 18 are attached to two generally concentric hoop bars 20, 22. Hoop bar 22 surrounds hoop bar 20, and both are arranged around the top of a column 24. Also shown in FIG. 4 are spacers 26 supporting the lower ends of the shear legs 18.

In the embodiment of FIGS. 3 and 4, each shear leg 18 forms a pair of hooks 28. The shape of each hook is broadly similar to that described with reference to FIG. 2 above, and because all the hooks are oriented in the same direction, they are uniformly spaced above the respective hoop bars 20 and 22. Each shear leg 18 forms a loop below the hoop bar to Which it is secured, and it is the base of the loop Which is supported by a spacer 26. It will be noted from FIG. 3 that the loops are respectively in planes parallel to the length of hoop bar to which they are attached while the hooks are all oriented in the same direction.

As is apparent from FIG. 4, the loop formed by each shear leg 18 below the hoop bar 20 is of generally triangular configuration. A leg section 30 depends from each hook 28, converging towards another section depending from an adjacent hook. The sections 30 merge in a smooth bend 32 which forms a lower anchorage point in the slab 34. Each hook is coupled to an upper slab reinforcment rod 10 (see FIG. I) and the bends 32 are substantially at the level of the lower reinforcement rods 36.

Figure 5:
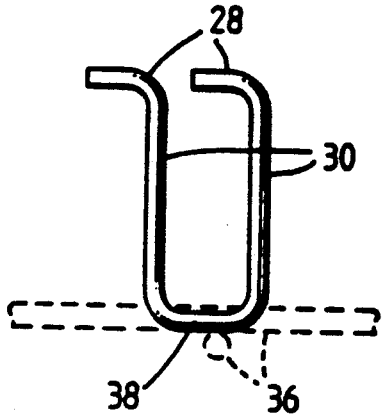
FIG. 5 illustrates an alternative form of shear leg for use in the embodiment of FIGS. 3 and 4.

FIG. 5 shows an alternative an preferred form of shear leg which also defines a loop. Here, the leg sections 30 are parallel, and connected at their lower ends by link section 38. This form of shear leg may be substituted directly for the legs of the FIG. 4 embodiment. As can be seen, the link section 38 provides a convenient means by which the shear leg may be supported, either on a spacer as shown at 26 in FIG. 4, or on a lower reinforcement rod 36. The two rods 36 shown in FIG. 5 are arranged orthogonally in the slab such that the link section 38 extends adjacent one rod while resting on the other.

Shearheads with shear legs of the kind shown in FIGS. 4 and 5 are particularly suited for installation after placement of the lower slab reinforcement. As shown in FIG. 4, the shearhead is lowered into positon after placement of the lower reinforcement rods 36, but before location of the upper rods 10, 12.

A steel mesh may be used in place of the spacers 26, having components intersecting within the body of the column 24 which support the shearhead. It will be appreciated from the description of FIG. 1 above, that such a mesh may be supported at the top of the column 24 prior to casting the slab and the overlaying column length. However, the mesh can of course be supported directly on the shuttering for the slab if preferred.

Figure 6:
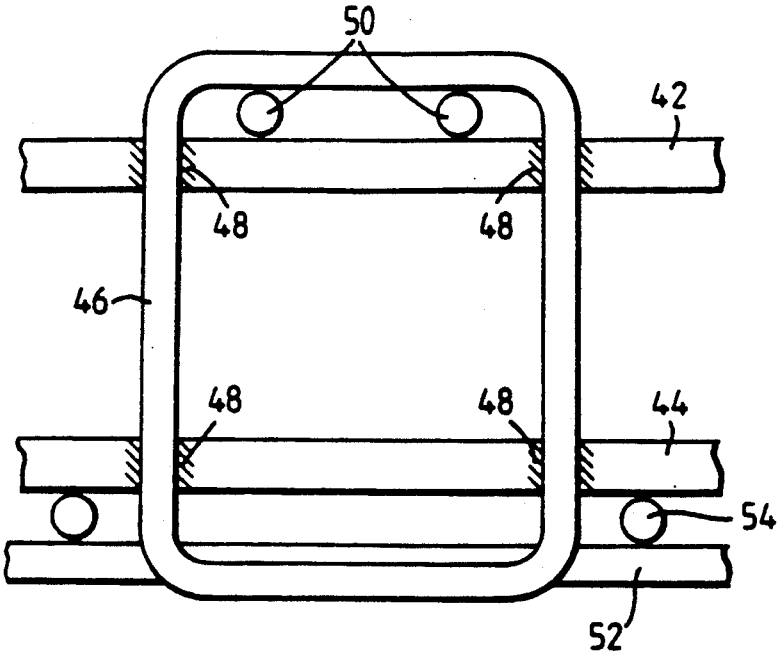
FIG. 6 is a schematic detailed view showing a shear leg supported on a shearhead according to a third embodiment of the invention.

The shearhead, a detail of which is shown in FIG. 6, comprises an upper hoop bar 42 and a lower hoop bar 44 to which a shear leg 46 is welded at 48. It will be appreciated that all these welds 48 are not required, but generally the shear leg will be secured to the hoops 42 and 44 at all four locations. The shear leg 46 is of generally rectangular shape, and the main reinforcement bars 50 are threaded through the upper portion of the shear leg which extends above the upper hoop bar 42. In this way, the shearhead as a whole can be supported on the slab reinforcement. Further slab reinforcement can also be threaded through the lower portion of the shear leg or on either side thereof as indicated at 54. Reinforcement will also be disposed below this slab reinforcement 54 as indicated at 52. The shear leg 46 will normally extend below the lowermost slab reinforcement 52, although without of course reducing the cover factor to an unacceptable level.

Figure 7:
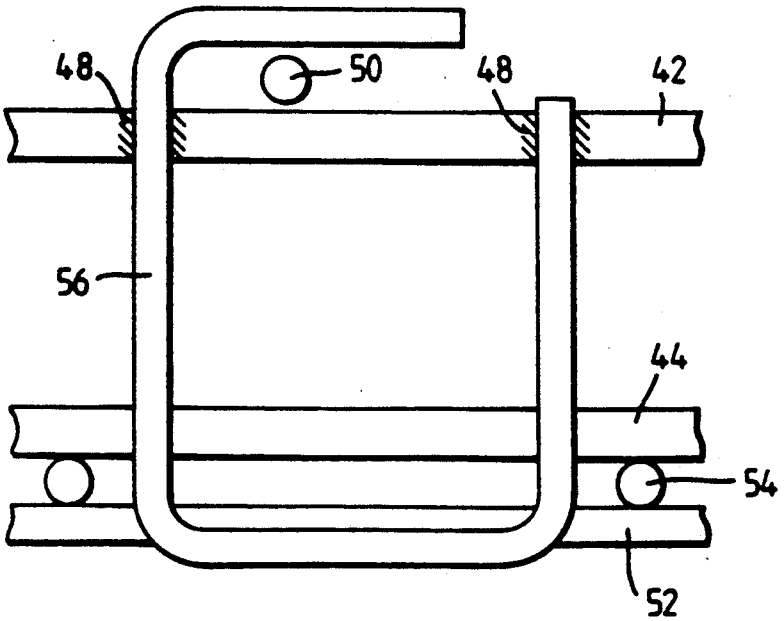
FIG. 7 is a view similar to FIG. 6 but showing an alternative form of shear leg.

The arrangement shown in FIG. 7 is broadly the same as that of FIG. 6 with the exception that the shear leg 56 does not complete a closed curve, but is open at one corner of the "rectangle". In this case, the shear leg is only welded to the upper hoop bar 42, and the lower hoop bar is simply supported on the slab reinforcement 54. The lower hoop bar 44 may be dispensed with in some circumstances.

Figure 8:
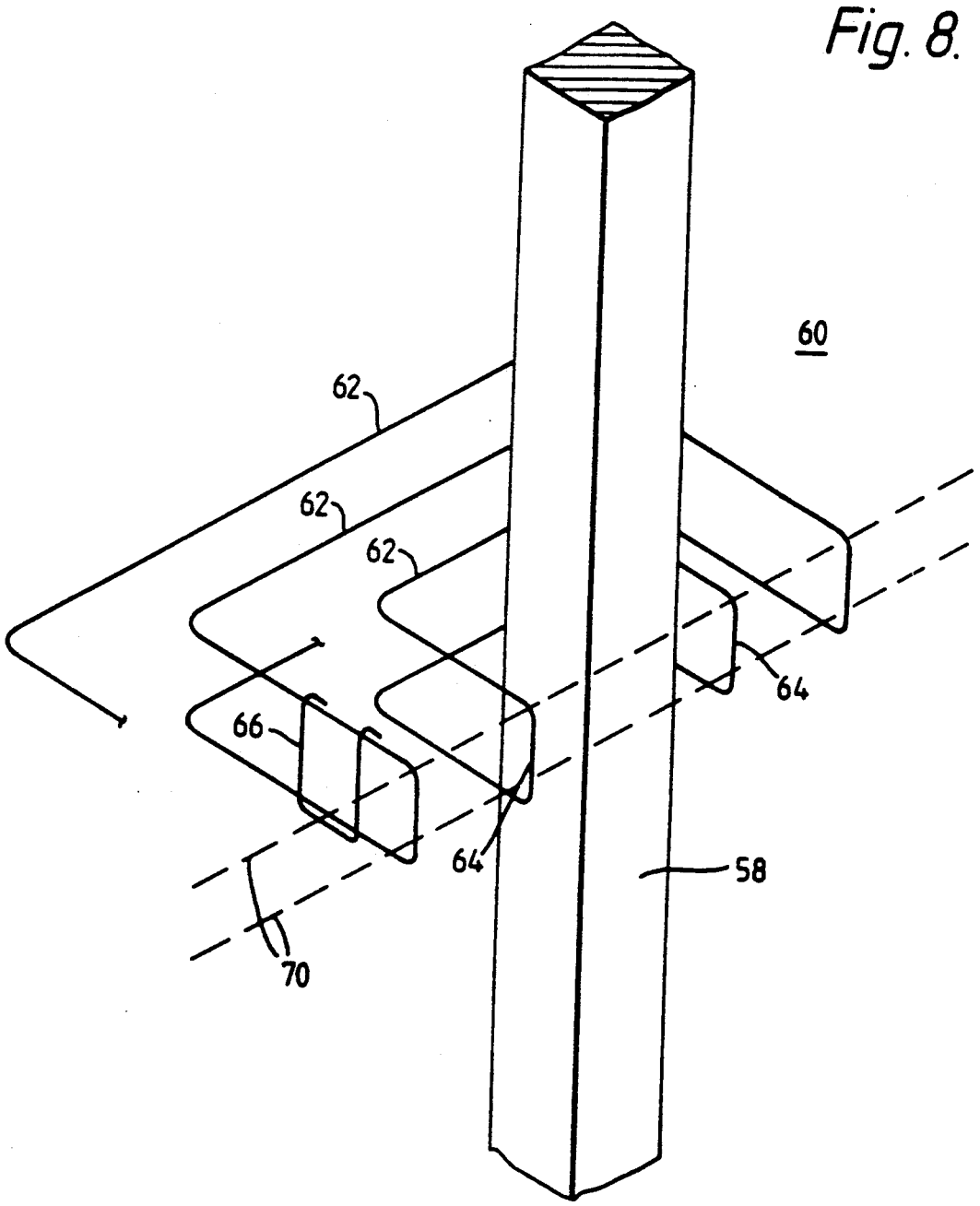
FIG. 8 is a schematic perspective view of a shearhead according to a fourth embodiment of the invention disposed against a peripheral pillar or column.
Figure 9:
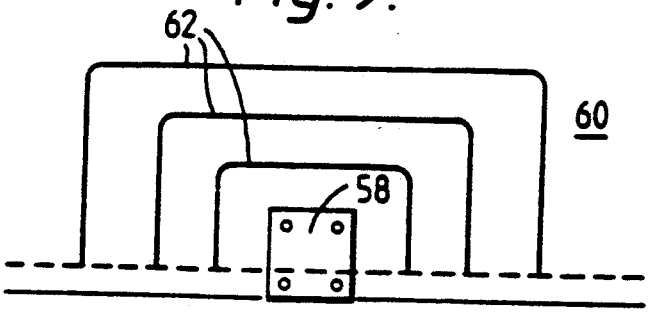
FIG. 9 is a schematic plan view of the arrangement of FIG. 8.
Figure 10:
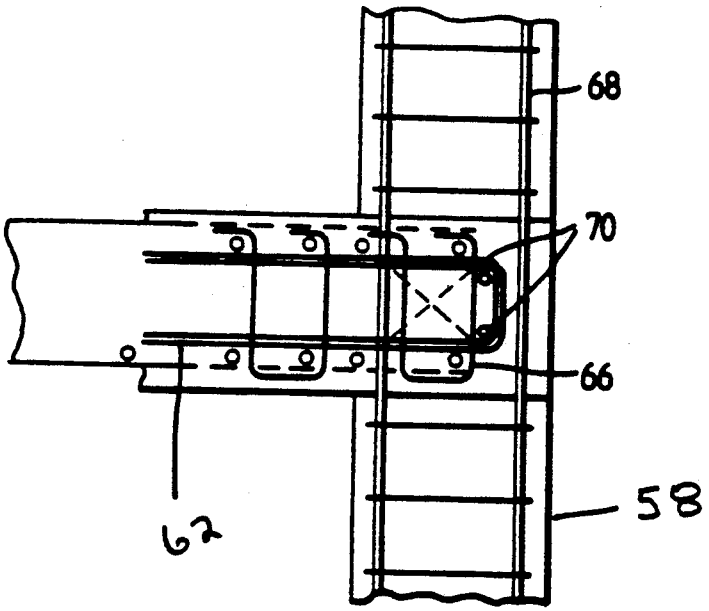
FIG. 10 is a schematic elevation of the arrangement shown in FIG. 8.

The shearhead illustrated in FIGS. 8 to 10 is shown comprising three hoop bars 62, each extending around three sides of a column 58. Each hoop bar 62 has an upper and lower portion linked by a vertical section 64. The hoop bars 62 are arranged generally concentrically around the column 58 in the slab 60, and shear legs 66 (only one is shown in FIG. 8) extend from above the upper hoop bar section to below the lower hoop bar section as do the shear legs described above with reference to FIGS. 6 and 7. It will be appreciated that shear legs of any suitable form can be used.

Referring particularly to FIG. 10, it can be seen how the hoop bars 62 form a torsion box Which extends generally horizontally through the column 58 at the periphery of the area being cast. FIG. 10 shows the column reinforcement 68 and additional reinforcement 70 around which the link sections 64 extend between the upper and lower portions of the hoop bar 62. In combination with the shear legs 66 mounted as shown, the hoop bar 62 combines with the reinforcement 70 to form a torsion box Which effectively reinforces the slab around the column.

Figure 11:
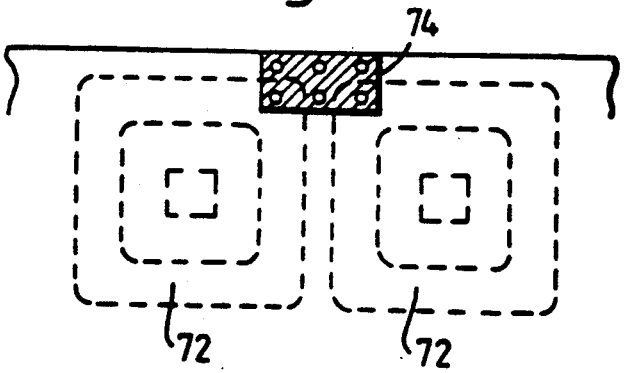
FIGS. 11 to 14 show how shearheads according to the invention can be used at the periphery of an area to be cast.
Figure 12:
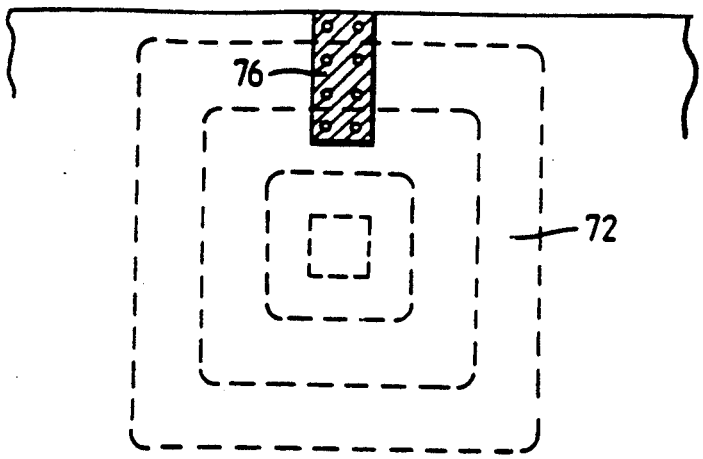
Figure 13:
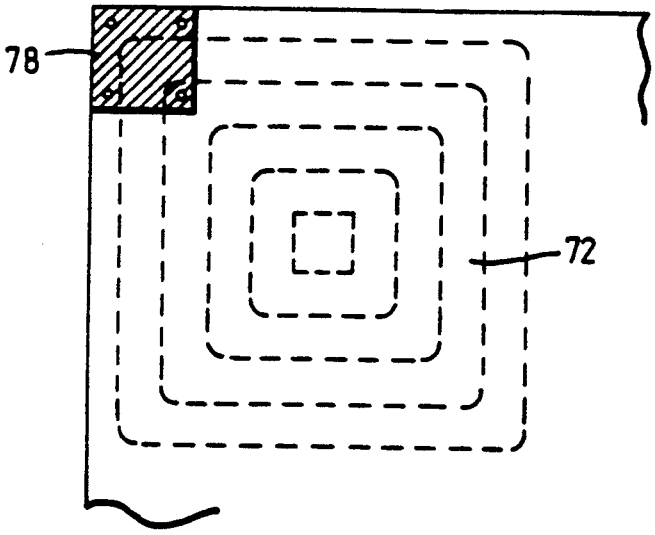
Figure 14:
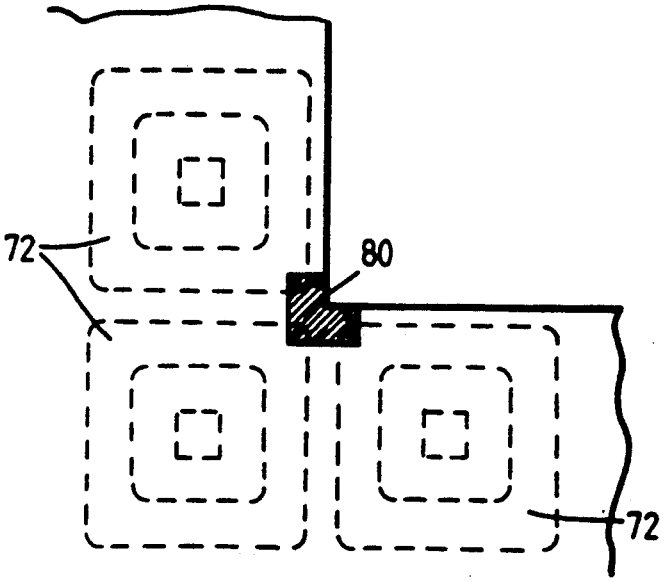

FIGS. 11 to 14 show how square or rectangular shearheads broadly of the kind described herein and in our earlier Application can also be put to good effect at the periphery of the area to be cast. FIG. 11 shows two shearheads 72 arranged side by side against the periphery of the cast area, with adjacent corners cast within the body of a pillar or column 74. FIG. 12 shows a single shearhead 72 with the cross-section of a column 76 extending generally perpendicularly into one side thereof. FIG. 13 shows how a shearhead 72 can be fitted into a corner with a corner thereof cast into a vertical column 78. FIG. 14 shows how three shearheads can be fitted around an obtuse corner, each coupled to a part of a vertical column 80.

Shearheads according to the invention are normally formed in steel and as noted above, are preferably of square or rectangular form. By way of example, for the mounting of a slab with a depth of 22 cm on a column 40 cm square, the inner hoop bar of FIG. 3 might be 60 cm square, with the outer bar being 90 cm square. Each hoop bar would typically be of 12 mm diameter steel, with the shear legs being in 8 mm steel for attachment to reinforcing rods of 16 mm steel in a slab having a 25 mm cover.

We claim:

1. A shearhead for casting within the body of a laterally extending slab to reinforce a junction between the slab and a supporting column, comprising a hoop bar for extending around the column with a plurality of shear legs attached thereto and depending therefrom, each shear leg including a portion extending above the hoop bar, which portion forms a hook for coupling to reinforcement in the slab.

2. A shearhead according to claim 1 wherein each shear leg is a single length of rod, one end of which forms the hook.

3. A shearhead according to claim 1 wherein each shear leg is a single length of rod extending in a loop below the hoop bar, with both ends of the rod including a portion extending above the hoop bar to form a said hook.

4. A shearhead according to claim 1 wherein the hoop bar extends substantially in one plane and the distal end of each hook extends substantially parallel to the plane of the hoop bar.

5. A shearhead according to claim 4 wherein the distal ends of all the hooks are parallel.

6. A shearhead according to claim 4 wherein the distal ends of a first set of the hooks extend in a first common direction, and the distal ends of a second set of the hooks extend in a second common direction perpendicular to said first direction.

7. A shearhead according to claim 6 wherein the first set of hooks are disposed further above the hoop bar than the second set of hooks.

8. A shearhead according to claim 1 wherein the hoop bar forms a substantially closed curve.

9. A shearhead according to claim 8 wherein the closed curve is substantially rectangular or square.

10. A shearhead according to claim 7 wherein the closed curve is substantially rectangular or square, and wherein the first set of hooks are part of the shear legs on two parallel sides of the hoop bar and second set of hooks are part of the sheer legs on the other two parallel sides of the hoop bar.

11. A shearhead according to claim 1 wherein the shear legs depend from the hoop bar in non-vertical directions.

12. A shearhead according to claim 1 including an additional hoop bar to which the shear legs are attached at the lower ends thereof.

* * * * *